US006142540A

United States Patent [19]

Girard et al.

[11] Patent Number: 6,142,540

[45] Date of Patent: Nov. 7, 2000

[54] MOTOR VEHICLE DOOR LOCK

[75] Inventors: Joël Girard, Abbeville; Jean-Philippe Hochart, Vauchelles les Quesnoy; Jean-Michel Roncin, Abbeville, all of France

[73] Assignee: Valeo Systemes de Fermetures, Sailly Flibeaucourt, France

[21] Appl. No.: 08/952,932

[22] PCT Filed: Mar. 26, 1997

[86] PCT No.: PCT/FR97/00534

§ 371 Date: Nov. 26, 1997

§ 102(e) Date: Nov. 26, 1997

[87] PCT Pub. No.: WO97/36074

PCT Pub. Date: Oct. 2, 1997

[30] Foreign Application Priority Data

Mar. 26, 1996 [FR] France ..... 96 03716

[51] Int. Cl.[7] ..... E05C 3/26

[52] U.S. Cl. ..... 292/216; 292/169.11; 292/201

[58] Field of Search ..... 292/169.11, 169.12, 292/169.14, 216, 201, DIG. 23, DIG. 27; 70/277, 278, 279

[56] References Cited

U.S. PATENT DOCUMENTS

| | | | |
|---|---|---|---|
| 4,974,886 | 12/1990 | Kleefeldt | 292/201 |
| 5,615,564 | 4/1997 | Inoue | 70/279 |
| 5,653,484 | 8/1997 | Brackmann | 292/216 |
| 5,666,834 | 9/1997 | Inoue | 70/237 |
| 5,702,136 | 12/1997 | Funk | 292/336.3 |
| 5,715,713 | 2/1998 | Aubry | 70/277 |

FOREIGN PATENT DOCUMENTS

| | | | |
|---|---|---|---|
| 2 488 645 | 2/1982 | France | E05B 65/36 |
| 2 635 355 | 2/1990 | France | E05B 65/36 |
| 43 03 365 A1 | 8/1994 | Germany | G05G 5/08 |
| 2 268 966 | 1/1994 | United Kingdom | E05B 65/20 |
| 2 284 635 | 6/1995 | United Kingdom | E05B 47/00 |
| WO 90/05822 | 5/1990 | WIPO | E05B 65/20 |

*Primary Examiner*—Suzanne Dino Barrett
*Assistant Examiner*—Gary Estremsky
*Attorney, Agent, or Firm*—Pollock, Vande Sande & Amernick

[57] ABSTRACT

A motor vehicle door lock is provided. An inside connecting device is connected at one end to an inside door opening element and at another end to an inside opening lever. The inside opening lever pivots about a first pin via the inside connecting device and the inside door opening element, whereby the inside opening lever engages a pawl which in turn engages a striker. An inside pivoting arm cooperates with the inside opening lever. The inside pivoting arm pivots about pin whereby it moves the inside opening lever between a locked and an unlocked position. In the locked position, the inside opening lever is not affected by the inside connecting device and in the unlocked position, the inside connecting device may act on the inside opening lever. Corresponding parts are also provided for an outside door opening element. The latch, pawl, levers and pivoting arms are all arranged parallel to the same face of a housing whereby their pins are perpendicular to the same face.

19 Claims, 5 Drawing Sheets

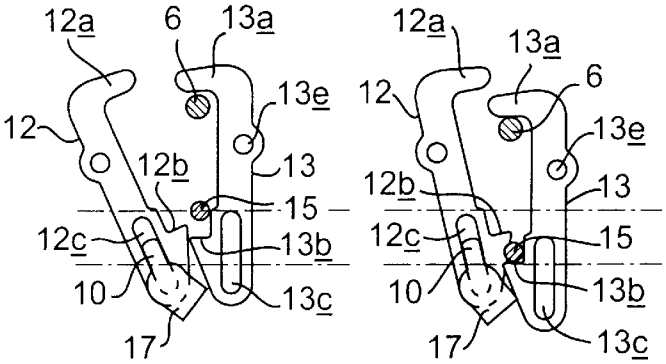
FIG. 10A
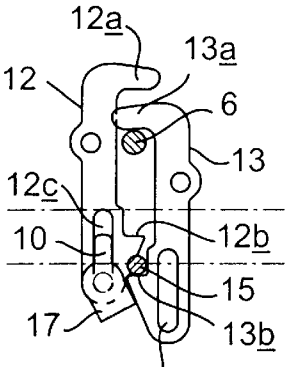
FIG. 10B
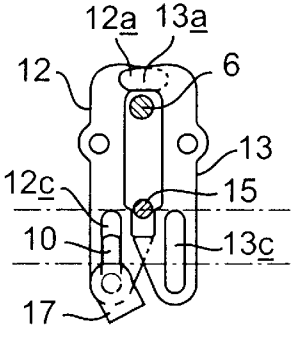
FIG. 10C
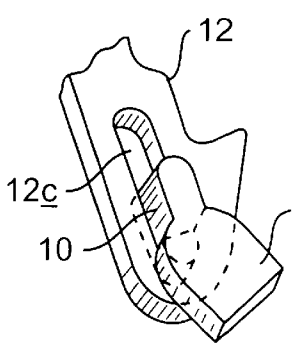
FIG. 10D
FIG. 11
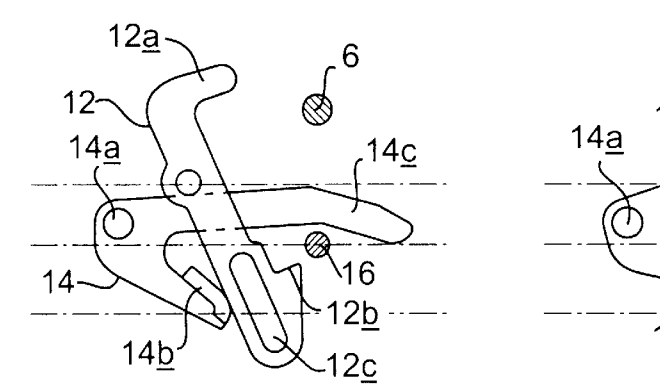
FIG. 12A
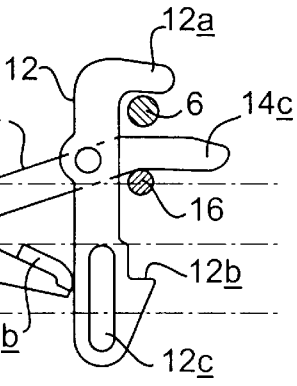
FIG. 12B
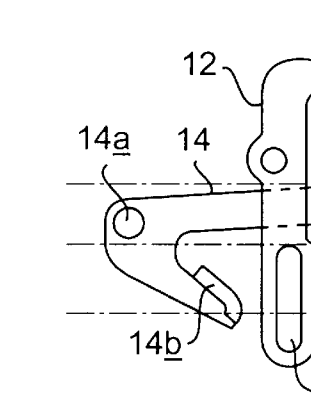
FIG. 12C

MOTOR VEHICLE DOOR LOCK

FIELD OF THE INVENTION

The invention relates to a motor vehicle door lock, especially of the type comprising a forked rotary latch and a rotary pawl that retains the latch.

BACKGROUND OF THE INVENTION

It is known that a motor vehicle door is generally held closed by a lock, the latch and pawl of which are arranged parallel to the edge of the door, the striker being secured to the bodywork pillar in the immediate vicinity of the edge of the door. The lock housing has a slot for the passage of the striker; the striker, when the door is closed, enters the fork of the latch, which pivots into a position in which it holds the striker which is kept in this position by the pawl. This well-known type of lock is always associated with a certain number of peripheral elements intended for operating the lock, namely, on the one hand, operating members for opening the door from the inside or from the outside of the passenger compartment and, on the other hand, locking and unlocking members which work from the inside or from the outside of the passenger compartment and, finally, safety members, for example a locking device that prevents the lock from being inadvertently opened by a child.

The presence of all these peripheral elements unfortunately causes locks of this type to have a complicated shape and means that the moving parts of the lock are arranged about pins which are parallel not only to the longitudinal axis of the vehicle, which is the case of the pawl and the latch, but also about pins parallel to the transverse axis and to the vertical axis of the vehicle. This therefore means that the locks have a complicated shape and given that the peripheral elements for operating the lock need to be protected against break-in, the locks need to have protective hoods of complex shape which are inconvenient for mounting the lock in the door; the more complex the shape of these hoods, the heavier and more expensive they become. Additionally is more though, locks of this type are extremely sensitive to sharp decelerations in the longitudinal direction of the vehicle because of the existence of the moving parts whose pins are perpendicular to the longitudinal axis of the vehicle. This means that these moving parts need, as a precaution, to be balanced by making some of their components heavier and subjecting them to springs. This then leads to an increase in the weight and cost of the lock.

Put another way, locks of the state of the art have the drawback of having bracket-shaped housings, the elements of which are not well able to withstand sharp decelerations in the event of an accident. The bracket shape resulting in that the cost and weight both of the structure of the constituent parts of the lock and of the hood are increased.

Obviously, it is highly desirable to produce a lock in which the housing could be more or less in the shape of a right-angled parallelogram, this lock then may have all of its elements in a plane perpendicular to the longitudinal axis of the vehicle.

SUMMARY OF THE INVENTION

The object of the invention is first of all to provide a lock in which all the pins of the moving parts are parallel to one and the same direction. Another object of the invention is to provide a lock in which all the constituent elements can be housed inside a more or less rectangular housing, of which the large faces, when mounted in the door, are positioned parallel to the edge of the door. Another object of the invention is to provide a lock in which the functions of opening, unlocking and locking from the inside and from the outside are independent, it being possible for the lock to be unlocked and locked mechanically or electrically.

The subject of the present invention is therefore a motor vehicle door lock, the lock being associated with members for operating it from the inside and from the outside which comprise, on the one hand, at least one door-opening element and, on the other hand, at least one element for locking/unlocking the lock, the lock interacting with two connecting devices (15, 16), one associated with the members for operating the lock from the inside, and the other associated with the members for operating the lock from the outside, each connecting device comprising a connecting element which can adopt at least two positions. The lock being characterized in that each connecting element of the connecting devices (15, 16) is associated with a lever (12, 13) and with a pivoting arm (11, 14), the two levers and the two pivoting arms being arranged parallel to one and the same face of the lock housing so that the pins **(9, 14*a*)** of the lock are all perpendicular to the face of the housing.

Provision may be made for the pivoting of the pivoting arm associated with the members for operating the lock from the outside to cause the pivoting of the pivoting arm associated with the members for operating the lock from the inside, so that unlocking from the outside causes unlocking from the inside.

Advantageously, the connecting element of a connecting device can adopt a so-called middle position and a so-called first extreme position, the said middle position corresponding to the absence of user action on the operating members connected mechanically to the lock and the first extreme position corresponding to user action on a door-opening element. Each connecting element of the connecting devices (15, 16) interacts within the lock housing 1, with a lever (12, 13) capable of making the lock open when the connection element moves from its middle position to its first extreme position. Each of these two levers (12, 13) is capable, on the one hand, when the lock is in the unlocked position, of pivoting about a pin **(10, 13*d*) under the action of a locking element in order to escape the action of its associated connecting element when it comes into its first extreme position and, on the other hand, when the lock is in the unlocked position, of pivoting the other way under the action of an unlocking element. The connecting element of at least one of the connecting devices (16) is capable, in order to allow the lock when in the locked position to be unlocked mechanically, of adopting a third position, the so-called second extreme position, and interacting with a pivoting arm (14) which is driven by the connecting element when the latter moves from its middle position to its second extreme position and which, by rotating, brings the lever (12)** associated with the connecting element into the angular position in which it allows the lock to open.

Provision may be made for the pivoting arm associated with the members for operating the lock from the inside to be controlled electrically to make the lever associated with the members for operating the lock from the inside pivot in the direction which brings it into the lock-locked position.

Furthermore, the elements for locking/unlocking the lock from the inside and from the outside may be controlled electrically and/or mechanically.

In a preferred embodiment, the connecting element of a connecting device moves in translation and the levers associated with the members for operating the lock from the inside and from the outside can also move in translation under the action of their respective connecting element, each lever being subject to a spring which returns it in the opposite direction to the one that corresponds to the action of the connecting element for opening the lock.

The lever associated with the members for operating the lock from the outside may advantageously be rotated electrically to bring it into its lock-locked position. It is also possible to make provision for the translation of the lever associated with the members for operating the lock from the inside in the direction of opening the lock, if the lever associated with the members for operating the lock from the outside is in the lock-locked position, to cause the lever to pivot to bring it into the lock-unlocked position.

Advantageously, the pivoting arm associated with the members for operating the lock from the inside can be rotated by the user by direct manual action on the end of its pin which is accessible on the lock housing in the edge of the door, in order to bring the lever associated with the members for operating the lock from the outside into its lock-locked position; thus even if there was a problem with the battery it is possible to lock the lock with respect to the outside, unlocking taking place by user action on the element for unlocking from the outside, which element acts on the pivoting arm for operating the lock from the outside.

As already proposed in French patent application 95/12133 filed by the Applicant Company, provision may advantageously be made for the connecting device associated with the members for operating the lock from the inside or from the outside to be a curved sheathed cable, particularly one positioned in a U-shape, inside the door, one of the ends of the sheath being fixed with respect to the vehicle door, while the other is connected to a manual unlocking element, when there is one, one of the ends of the cable being connected to the door-opening element, while the other constitutes the connecting element that acts on the lock.

The housing of the lock according to the invention is covered by a protective hood which forms a simple cover given the right-angled rectangular shape of the lock, one large face of which is positioned parallel to the edge of the door.

The lock according to the invention preferably comprises a rotary forked latch and a pawl for retaining the latch.

BRIEF DESCRIPTION OF THE DRAWINGS

To make the subject of the invention easier to understand, one embodiment thereof, depicted in the appended drawing, will now be described by way of a purely illustrative and non-limiting example.

In this drawing:

FIGS. 10A, 10B, 10C and 10D depict diagrammatically the interaction of the two levers when the action of opening the lock from the inside causes the lock operation from the outside to be unlocked;

FIG. 11 depicts, in perspective, the part that is fitted to the lever for operating the lock from the outside in order to obtain the functioning depicted in FIG. 10;

FIGS. 12A, 12B and 12C depict diagrammatically the lever and the pivoting arm for operating the lock from the outside during manual unlocking action from the outside, these figures corresponding to the drawing of French patent application 95/12133.

DETAILED DESCRIPTION OF THE DRAWINGS

Figure 2:
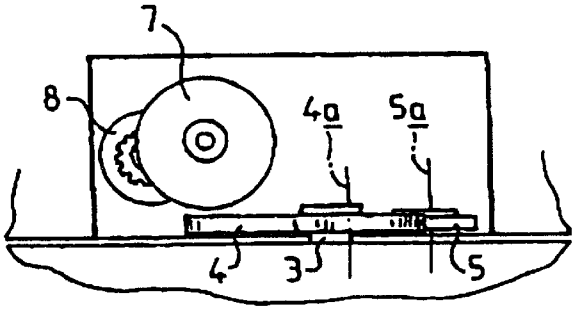
FIG. 2 depicts diagrammatically a view on II—II of FIG. 1 when the lock is positioned inside a closed vehicle door.
Figure 5:
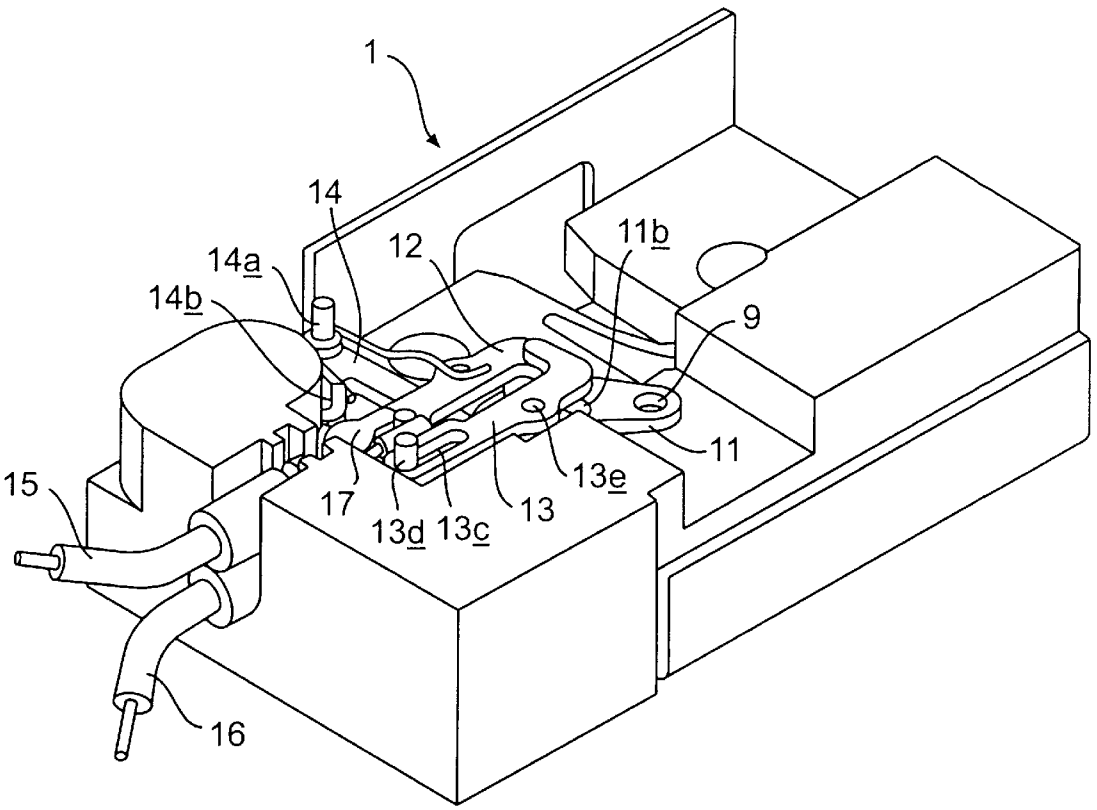
FIG. 5 depicts a view in perspective of the levers and pivoting arms of the lock.

Referring to the drawing, it can be seen that 1 has been used to denote, in its entirety, the housing of the lock according to the invention. The housing 1 has a right-angled rectangular shape and on one of its large faces it has a slot 2 to allow the passage of a striker 3 which is fixed to the bodywork pillar associated with the door where the lock is to be placed. The lock has a fork-shaped latch 4 and a pawl 5 which interacts with the latch to lock it in the position in which it holds the striker in one of the branches of its fork. The lock closes when the door is slammed shut and the striker pushes the latch back. When the lock is to be opened so that the vehicle door can be opened, the pawl 5 needs to be pulled to disengage it from its region of contact with the latch, this pulling being achieved by exerting a force on the post 6 of the pawl. The pins of the latch and of the pawl are perpendicular to the large faces of the housing 1, that is to say arranged parallel to the longitudinal axis of the vehicle when the door is closed. These pins have been denoted by 4*a* and 5*a* respectively and have been represented diagrammatically by a chain line of the same reference in FIG. 2.

In the lock described, by way of example, the functions of locking it from the outside and from the inside are fulfilled electrically by means of two actuators 7, 8 which are electric motors powered by the vehicle battery. The motors 7, 8 via a set of gears and a worm drive a pivoting dog 7*a*, 8*a* whose pivot pin, 9 and 10 respectively, interacts, the former with a pivoting arm 11 for operating the lock from the inside, and the latter, with a lever 12 for operating the lock from the outside.

Figure 3:
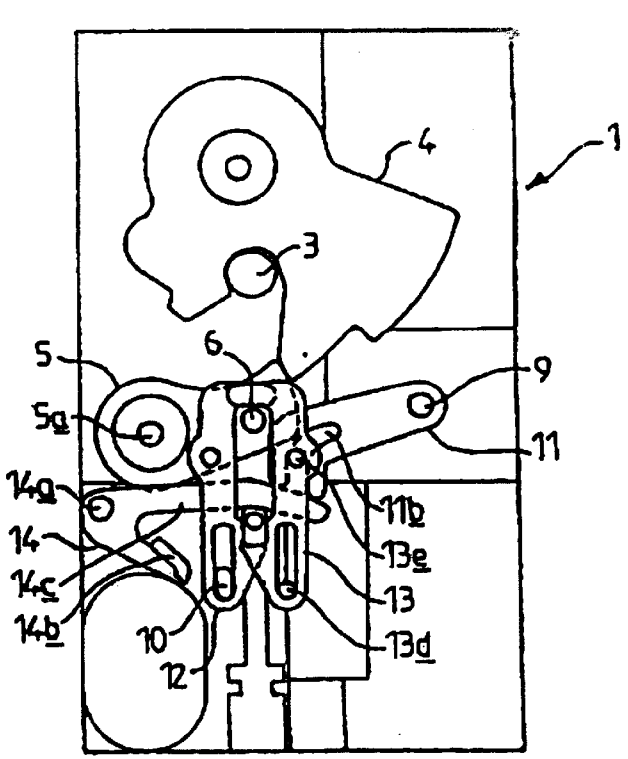
FIG. 3 depicts diagrammatically, viewed in plan, the lock of FIG. 1 also showing the two levers for opening from the inside and from the outside and the pivoting arms associated with each of these two levers.
Figure 1:
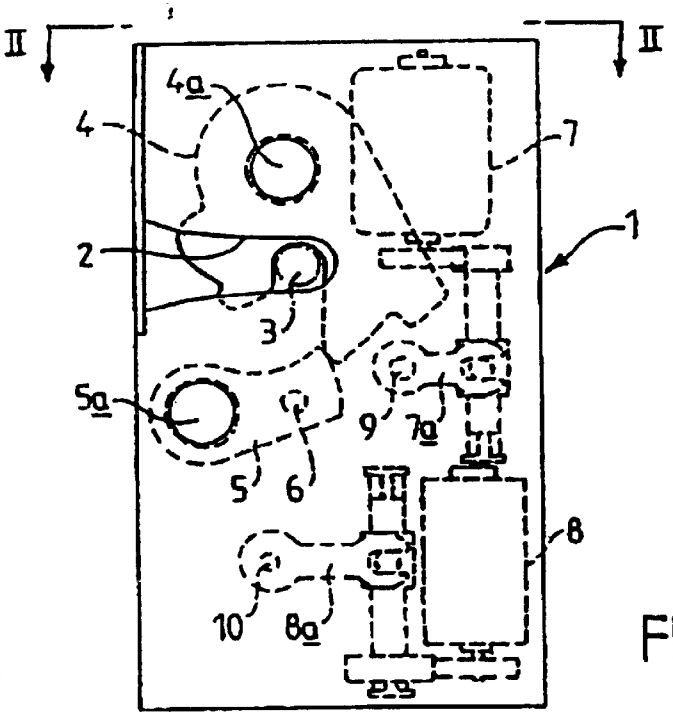
FIG. 1 depicts diagrammatically, viewed in plan, a lock according to the invention in which only the latch, the pawl and the position of the electric actuators which rotate the two pins allowing the lock to be locked from the outside and from the inside are shown.
Figure 4:
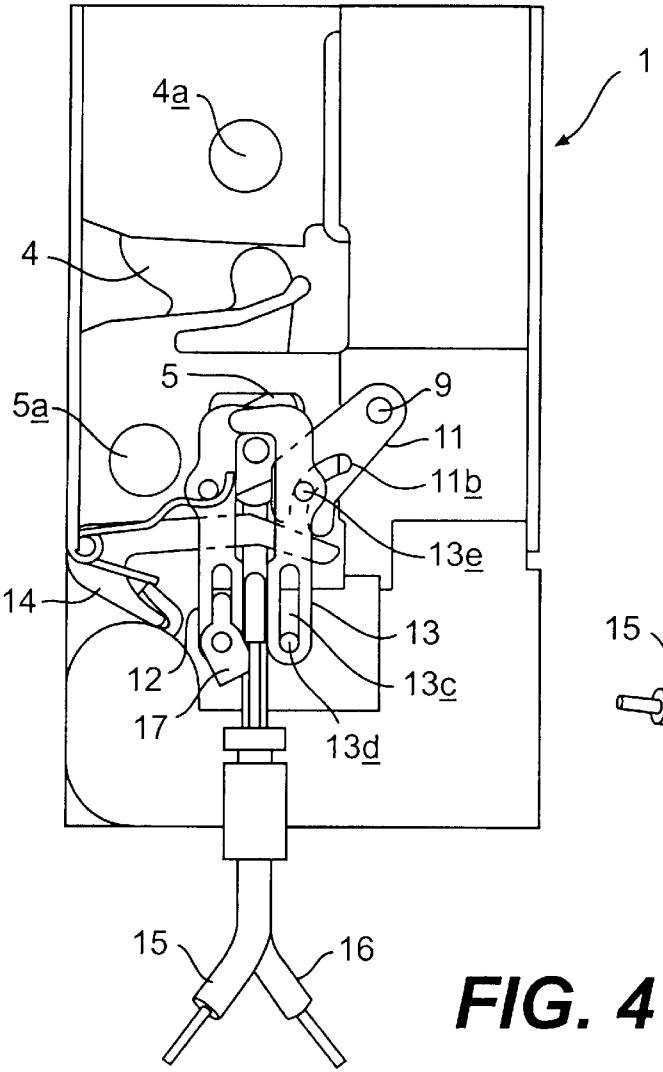
FIG. 4 depicts a view similar to FIG. 3 also showing the ends of the connecting devices that allow the lock to be operated.

Referring now more specifically to FIGS. 3 and 4, it can be seen that the lock according to this embodiment of the invention has a mechanism that consists, on the one hand, for operating it from the inside, of a lever 13 and of a pivoting arm 11 and, on the other hand, for operating it from the outside, of a lever 12 and a pivoting arm 14. These four parts are arranged parallel to one another in different planes with respect to the large faces of the housing 1. The pivoting arm 14 is the one whose plane is closest to the pawl 5; in a first adjacent plane (moving away from the pawl 5) are the lever 12 and the pivoting arm 11; in a second plane adjacent to the first (moving away from the pawl 5) is the lever 13. The levers 12 and 13 have identical shapes; at one end they have a bracket-shaped tab 12*a,* 13*a* respectively, and at their other end they have a cusp 12*b,* 13*b* respectively, near which there is an oblong cut-out 12*c,* 13*c* respectively. One of the edges of the cusp is perpendicular to the longitudinal mid-line of the lever, and the other edge is oblique and forms an acute angle with the mid-line. In the housing 1, the two levers are positioned in such a way that their right-angled tabs 12*a,* 13*a* are arranged one over the other. The pins 10 and 13*d* respectively are placed in the oblong cut-outs 12*c,* 13*c*. The pin 13*d* is a cylindrical pin which has the sole function of limiting the translational travel of the lever 13; by contrast, the pin 10 has a cross section with flaps and can cause the lever 12 to rotate under the action of the actuator 8; however, it also allows translational movement of the lever 12 with respect to the pin 10.

The pivoting arm 14 can rotate about its pin 14*a;* the pins 4*a,* 5*a,* 9, 13*d,* 10 and 14*a* are parallel. The pivoting arm 14 has a forked shape, and when the lock is in the position of rest depicted in FIG. 3, one of the branches 14*b* of the fork can interact with the edge of the lever 12 while the other branch 14*c* of the fork interacts with a stud 11*a* born by the pivoting arm 11 on its face, which faces the pivoting arm 14.

The pivoting arm 11 has a slot 11*b* which opens to the outside of the arm; the mid-line of this slot 11*b* is, first of all, starting from the outside, a straight segment, then a curved segment, the curved segment bending the slot towards the pin 9. Placed in this slot 11*b* is a stud 13*e* which projects from that face of the lever 13 which faces the pivoting arm 11. The straight segment of the slot 11*b* allows a translation of the lever 13 with respect to the pivoting arm 11; the curved segment of the slot 11*b* allows the lever 13 to be made to pivot with respect to the pin 13*d* when the pivoting arm 11 is pivoted about the pin 9. The levers 12 and 13 are each subject to a return spring which tends to return them to a position in which the pins 10 and 13*d* are respectively pressing against the end of their associated oblong cut-out.

Figure 6:
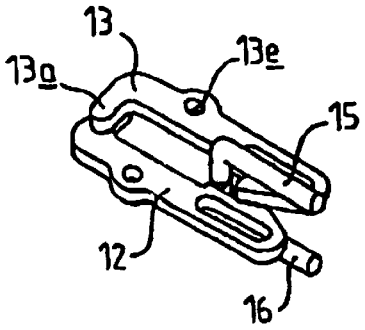
FIG. 6 depicts, in perspective, the interaction between the two connecting elements and the two levers of the lock.

The lock is worked by means of two connecting devices each of which consists of a sheathed cable. One of the devices 15 corresponds to operating the lock from the inside while the other device 16 corresponds to operating it from the outside. Each sheathed cable is U-shaped and corresponds to the device described in French patent application 95/12133. The sheath of the cable 16 is connected by one of its ends to the lock housing 1 and, by its other end, to the moving part of a door cylinder; the sheath of the cable 15 is connected by one of its ends to the lock housing 1 and by its other end to the door chassis. The cable of these connecting devices is secured, at one of its ends, to a door-opening element consisting, for example, of a door handle and, at its opposite end, the cable interacts with one of the cusps 12*b,* 13*b* of the two levers 12 and 13 respectively. FIG. 6 depicts the interaction of the two cables with the levers 12 and 13, in detail.

Aligned with the slatted pin 10 there is a plate 17 which is clearly visible in FIGS. 10 and 11. The plate 17 is placed above the plane of the lever 12, level with the plane of the lever 13, and when the lever 13 is translated parallel to the large side of the housing 1, the oblique edge of the cusp 13*b* comes into contact with the edge of the plate 17 and causes the lever 12 to rotate if this lever was at an angle with respect to the lever 13, so as to bring it parallel to the lever 13.

Figure 7A:
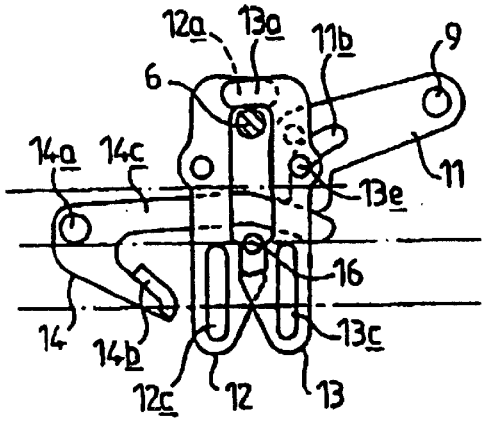
FIGS. 7A and 7B depict diagrammatically the operation of opening the lock mechanism from the outside.
Figure 7B:
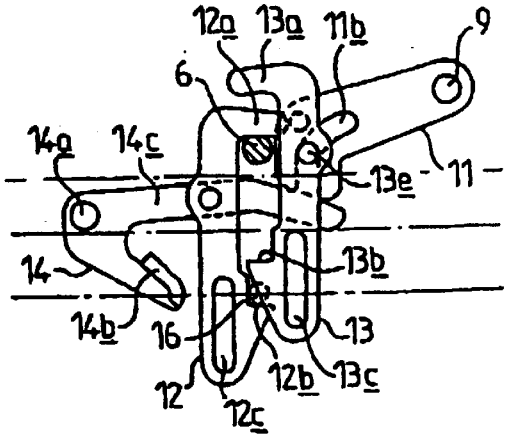
Figure 7C:
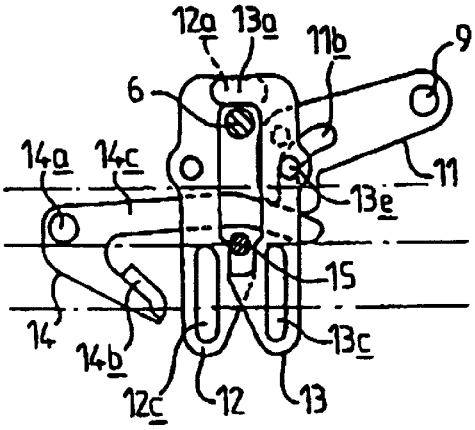
FIGS. 7C and 7D depict diagrammatically the operation of opening it from the inside.
Figure 7D:
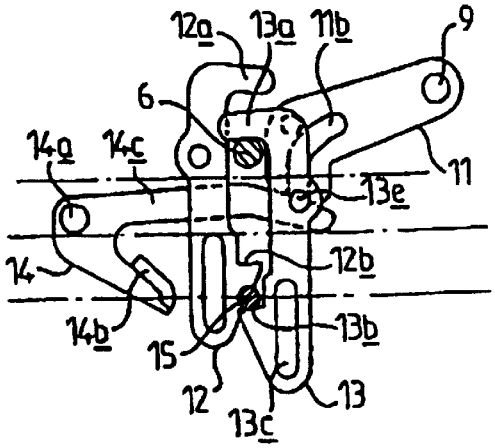

The way in which the mechanism which has just been described works will be detailed below Referring to FIGS. 7, it can be seen that FIG. 7A depicts the two levers 12 and 13 and the two pivoting arms 11 and 14 in the position that corresponds to a non-locked lock, with the door closed. If the door needs to be opened, the post 6 of the pawl has to be brought downwards in FIGS. 7. FIG. 7B depicts the movement of the lever 12 by means of the connecting element of the connecting device 16, which corresponds to opening from the outside under the action of the door handle. When the door handle is released, the lever 12 resumes the position it had in FIG. 7A because of the action of its return spring, but the pawl post 6 does not move back up into the position it had initially, given that the pawl 5 comes to rest on the lateral edge of the latch 4. If the door is slammed, the pawl post 6 returns to the position it had in FIG. 7A. FIGS. 7C and 7D depict the operation of the mechanical system for operating the lock using the internal door handle. In this case, the connecting element 15 acts on the cusp 13*b* of the lever 13 and forces the lever 13 downwards in FIGS. 7. The bracket-shaped tab of the lever 13 drives the post 6 downwards, which causes the lock to open. The stud 13*e* slides in the straight part of the slot 11*b* without any change to the position of the pivoting arm 11. When the action on the door handle is released, the connecting element of the connecting device 15 returns to the initial position it had in FIG. 7C; however, the pawl post 6 remains more or less in the lowered position, like it did when opened from the outside. The lever 13 is returned by its return spring to its initial position it occupied before the opening operation, and which is depicted in FIG. 7C. As before, if the door is closed by slamming it, the post 6 moves back up to attain its initial position below the bracket-shaped tabs 12*a,* 13*a* of the two levers.

Figure 8A:
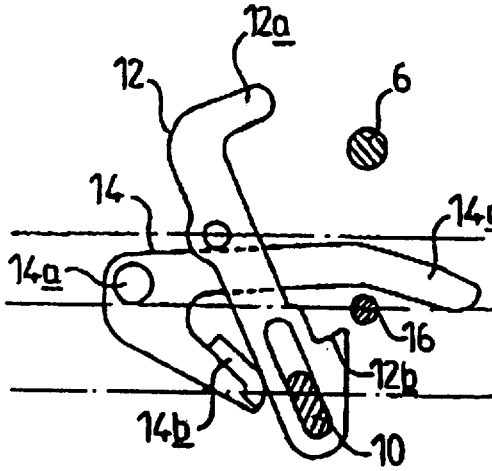
FIGS. 8A and 8B depict diagrammatically workings of the lever and pivoting arm for operating the lock from the outside, when the lock is being locked or unlocked electrically.
Figure 8B:
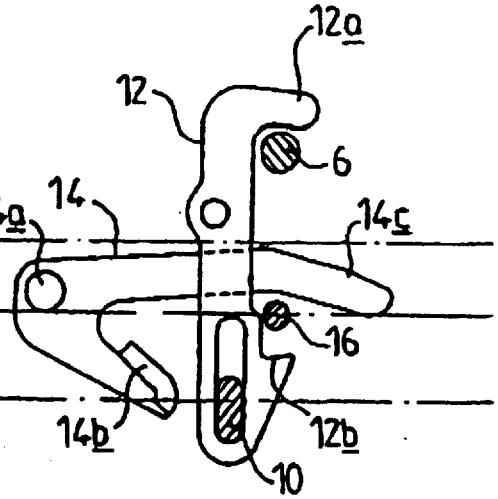

Referring now to FIGS. 8, it can be seen that FIG. 8A depicts the position of the lever 12 and of the pivoting arm 14 when the means of opening from the outside has been locked electrically. FIG. 8B depicts the unlocked position, which corresponds to that of FIGS. 7: the lever 12 has its mid-line parallel to the longest sides of the lock.

If the pin 10 is operated by the actuator 8, the lever 12 can be brought into the position depicted in FIG. 8A, in which it makes an acute angle with its previous position. In this position, the movement of the connecting element 16 is along the oblique edge, which delimits the cusp 12*b,* which means that movement of the connecting element 16 does not in any way alter the position of the lever 12, this corresponding to it being impossible for the pawl post 6 to be maneuvered by the lever 12 and therefore to it being impossible for the lock to be locked from the outside. Unlocking is obtained by making the pin 10 pivot the other way to bring the lever 12 into the position depicted in FIG. 8B.

Figure 9A:
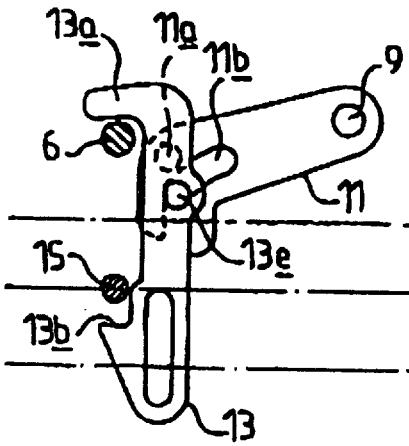
FIGS. 9 and 9B depict diagrammatically the workings of the lever and of the pivoting arm for operating the lock from the inside, when the safety function known as "child lock" or "deadlock" function is being used.
Figure 9B:
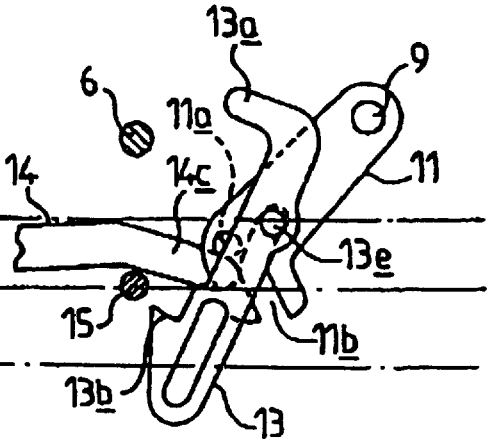

FIGS. 9 depict the kinematics of locking or unlocking the lock from the inside. This scenario corresponds to a safety feature to prevent the door from being opened by children inside the vehicle, and also corresponds to what is known as "deadlocking", namely the fact that it is impossible, should the vehicle be broken into by breaking a window, to open the door from inside the vehicle. The unlocked position is depicted in FIG. 9A, and in this case the lever 13 and the pivoting arm 11 are again in the position that they occupied in FIG. 7A. To lock the door from the inside, the pivoting arm 11 is pivoted by making the actuator 7 rotate its pin 9; during this pivoting, the stud 13*e* of the lever 13 slides in the curved part of the slot 11*b*, and this causes the lever 13 to pivot into a position that is symmetric to the one the lever 12 adopted to provide locking from the outside. In these conditions, the oblique edge of the cusp 13*b* moves along the travel of the connecting element 15 as the latter moves under the action of the interior door handle being operated. This means that the connecting element 15 can no longer impart any movement to the lever 13, and this corresponds to locking from the inside.

As has been seen hitherto, unlocking from the outside is achieved electrically. However, there may be a problem with the vehicle battery, in which it is necessary to provide external unlocking by manual action on the barrel which is associated with at least one of the locks of the vehicle. In this case, operating the barrel using the user's key causes, as was explained in French patent application 95/12133, the connecting element of the connecting device 16 to move from its middle position which corresponds to a position of rest and is depicted in FIG. 12A, into its second extreme position, which corresponds to the one opposite the extreme position that causes the lock to open. In this movement, the connecting element operates the pivoting arm 14 to make it pivot about its pin 14*a*. Given that the lock is assumed to be locked from the outside, the lever 12 is in a position at an angle that corresponds to the position depicted in FIG. 8A. When the pivoting arm 14 turns under the action of the connecting element of the connecting device 16, the branch 14*b* comes to rest against the lever 12, which causes the lever 12 to pivot to bring it into a position in which its mid-line is parallel to the largest sides of the housing 1; in this position, the bracket-shaped tab 12*a* comes into line with the pawl post 6. If the barrel is returned to the state of rest, the connecting element returns to its middle position, which is depicted in FIG. 12C; and in this case, subsequent operation of the external door handle causes the lever 12 to translate and therefore the door to open. The manual emergency function is thus provided so that unlocking can take place from the outside, even when there is a problem with the battery.

It may happen that both levers 12 and 13 are in the locked position and that the lock is unlocked from the outside as mentioned earlier. In this case, if the user were to get into his car and close the door behind him he would no longer be able to open it from inside, unless he unlocked it electrically from the inside, something that would be impossible if there was a problem with the battery. In the lock according to the invention, provision has been made to bring the lever 13 into its unlocked position at the same time as the lever 12 is brought, by the emergency function, into its unlocked position. To achieve this, the end of the branch 14*c* of the pivoting arm 14 comes to rest against the stub 11*a* of the pivoting arm 11, so that when the pivoting arm 14 pivots to provide emergency unlocking from the outside, it causes the pivoting arm 11 to rotate to bring it from the position that corresponds to FIG. 9B into the position that corresponds to FIG. 9A, in which position the lever 13 has its mid-line parallel to the longest sides of the housing 1. Unlocking from the outside using the emergency function thus automatically causes unlocking from the inside.

The lock according to the invention may also provide another safety effect. Now, if the lock is locked from the outside and unlocked from the inside it would be possible for a user inside the passenger compartment to open the door using the interior door handle, after which, if he should inadvertently slam the vehicle door shut leaving the key inside the passenger compartment, he would be unable to open the door lock from the outside. To avoid this drawback, the plate 17 has been fitted to the pin 10 at the level of the lever 13. If the user, when the lock is in the position defined above, which corresponds to FIG. 10A, operates the interior door handle, he causes the translation of the lever 13 as depicted in FIG. 10B; towards the end of the translational travel of the lever 13, the oblique edge of the cusp 13*b* comes into contact with the plate 17, which causes the lever 12 to rotate about its pin 10 until this lever comes into the unlocked position, as depicted in FIG. 10C. In this case, when the user releases the interior door-opening handle, the lever 13 returns to its up position under the effect of its return spring and if the user slams the door, the two levers are in the unlocked position, which means that the user can get back into his vehicle, this position being depicted in FIG. 10D.

Finally, the lock gives one last safety function in the event of a problem with the battery. If it is assumed that the lever 12 is in the unlocked position, the user can no longer lock the lock from the outside. Now, if he wishes to go and seek help, it is desirable for him to be able to secure his vehicle during his absence. In this case, the user opens his door to access the edge of the door and the large face of the housing, which lies flush with the edge of the door. On this large face, the pin 9 of the pivoting arm 11 is accessible via its end. A slot that can take a tool such as a screw driver, a key or a coin is provided on the end of the pin 9, and this pin 9 is turned to make it move the pivoting arm 11 in the opposite direction to the direction in which it pivots to provide locking from the inside. In this case, the end of the pivoting arm 11 comes into contact with the end of the bracket-shaped tab 12*a* of the lever 12 and makes the lever 12 pivot into its locked position. When the rotating action performed by the user on the pin 9 ceases, the pivoting arm 11 returns to its initial position under the effect of a return spring. If the user then slams his door, the lock will be locked from the outside and the user will be able to get back into his vehicle by using his key in the barrel, as indicated hereinabove when we described the emergency manual unlocking function.

We claim:

1. A door lock comprising, in a housing:

an inside connecting device having one end for connecting to an inside door opening element and another end connected to an inside opening lever, the inside opening lever being movable about a first pin between at least two positions via said inside connecting device and said inside door opening element, whereby the inside opening lever engages a pawl;

an outside connecting device having one end for connecting to an outside door opening element and another end connected to an outside opening lever, the outside opening lever being movable about a second pin between at least two positions via said outside connecting device and said outside door opening element, whereby the outside opening lever engages the pawl;

a rotatory latch moveable around a fifth pin and being adapted to hold a striker when the latch is retained by the pawl, the pawl being moveable about a sixth pin by either the inside opening lever or the outside opening lever to release the latch;

an outside pivoting arm cooperating with the outside opening lever, the outside pivoting arm pivots about a third pin moving the outside opening lever about the second pin between a locked position wherein the outside opening lever is not affected by the outside connecting device and an unlocked position wherein the outside connecting device can operate the outside opening lever; and an inside pivoting arm cooperating with the inside opening lever, the inside pivoting arm pivots about a fourth pin moving the inside opening lever about the first pin between a locked position wherein the inside opening lever is not affected by the inside connecting device and an unlocked position wherein the inside connecting device can operate the inside opening lever;

wherein the latch, the pawl, the inside and outside opening levers, and the inside and outside pivoting arms are all arranged parallel to a same face of the housing whereby all the pins are perpendicular to the same face.

2. Lock according to claim 1, wherein the pivoting of the outside pivoting arm causes the pivoting of the inside pivoting arm so that unlocking from the outside causes unlocking from the inside.

3. Lock according to claim 2, characterized in that the elements for locking/unlocking the lock from the inside and from the outside are controlled electrically and/or mechanically.

4. Lock according to claim 5, characterized in that the elements for locking/unlocking the lock from the inside and from the outside are controlled electrically and/or mechanically.

5. Lock according to claim 1, wherein the inside pivoting arm is controlled electrically to make the inside opening lever pivot in the direction which brings it into a lock-locked position.

6. Lock according to claim 1 wherein the inside and outside pivoting arms are controlled electrically and/or mechanically.

7. Lock according to claim 1, wherein the connecting devices move in translation and that the inside and outside opening levers also move in translation under the action of their respective connecting device, each lever being subject to a spring which returns it in the opposite direction to the one that corresponds to the action of the connecting element for opening the lock.

8. Lock according to claim 1, wherein the outside opening lever is rotated electrically to bring it into its lock-locked position.

9. Lock according to claim 7, wherein the translation of the inside opening lever, if the outside opening lever is in a lock-locked position, causes the outside opening lever to pivot to bring it into a lock-unlocked position.

10. Lock according to claim 1, wherein the inside pivoting arm in order to bring the outside opening lever into a lock-locked position.

11. Lock according to claim 1, wherein at least one of the connecting devices is a curved sheathed cable adapted to be mounted inside a door, one of the ends of the sheath being stationary with respect to the door, while the other is connected to a manual unlocking element, one of the ends of the cable being connected to its respective door-opening element, while the other acts on the lock.

12. Lock according to claim 2, wherein the inside pivoting arm is controlled electrically to make the inside opening lever pivot in the direction which brings it into the lock-locked position.

13. The apparatus of claim 1 wherein the connecting devices may adopt a middle position corresponding to no user action on the opening element and a first extreme position corresponding to user action on the opening element, each connecting device interacting with its respective lever to open the lock when the connection device moves from the middle position to the first extreme position.

14. Lock according to claim 13, wherein the inside pivoting arm is controlled electrically to make the inside opening lever pivot in the direction which brings it into the lock-locked position.

15. Lock according to claim 2, wherein the connecting devices move in translation and that the inside and outside opening levers can also move in translation under the action of their respective connecting device, each lever being subject to a spring which returns it in the opposite direction to the one that corresponds to the action of the connecting device for opening the lock.

16. Lock according to claim 13, wherein the connecting devices move in translation and that the inside and outside opening levers can also move in translation under the action of their respective connecting device, each lever being subject to a spring which returns it in the opposite direction to the one that corresponds to the action of the connecting device for opening the lock.

17. Lock according to claim 5, wherein the connecting devices move in translation and that the inside and outside opening levers can also move in translation under the action of their respective connecting device, each lever being subject to a spring which returns it in the opposite direction to the one that corresponds to the action of the connecting device for opening the lock.

18. Lock according to claim 6, wherein the connecting devices move in translation and that the inside and outside opening levers can also move in translation under the action of their respective connecting element, each lever being subject to a spring which returns it in the opposite direction to the one that corresponds to the action of the connecting element for opening the lock.

19. The apparatus according to claim 13 wherein at least one of the connecting elements adopts a second extreme position in which the respective pivoting arm driven by the connecting element rotates its respective lever into an angular position to allow the lock to open.

* * * * *

UNITED STATES PATENT AND TRADEMARK OFFICE

CERTIFICATE OF CORRECTION

PATENT NO. : 6,142,540
DATED : November 7, 2000
INVENTOR(S) : Joel Girard et al.

It is certified that error appears in the above-identified patent and that said Letters Patent is hereby corrected as shown below:

Column 9,
Lines 18-21, Claim 4 should read as follows:

4. Lock according to claim [5] 1, characterized in that the elements for locking/unlocking the lock from the inside and from the outside are controlled electrically and/or mechanically.

Column 9,
Lines 29-35, Claim 7, should read as follows:

7. Lock according to claim 1, wherein the connecting devices move in translation and [that] the inside and outside opening levers also move in translation under the action of their respective connecting device, each lever being subject to a spring which returns it in the opposite direction to the one that corresponds to the action of the connecting element for opening the lock.

Column 9,
Lines 39-42, Claim 10 should read as follows:
10. Lock according to claim 1, wherein the inside pivoting arm can be rotated by the user by direct manual action on the end of its axis which is accessible on the lock housing in the edge of the door, in order to bring the outside opening lever into a lock-locked position.

Column 10,
Lines 5-11, Claim 13, should read as follows:

13. [The apparatus of] Lock according to claim 1 wherein the connecting devices may adopt a middle position corresponding to no user action on the opening element and a first extreme position corresponding to user action on the opening element, each connecting device interacting with its respective lever to open the lock when the connection device moves from the middle position to the first extreme position.

UNITED STATES PATENT AND TRADEMARK OFFICE

CERTIFICATE OF CORRECTION

PATENT NO. : 6,142,540
DATED : November 7, 2000
INVENTOR(S) : Joel Girard et al.

It is certified that error appears in the above-identified patent and that said Letters Patent is hereby corrected as shown below:

Column 10,
Lines 17-50, for the following claims: Claim 15 should read as follows:

15. Lock according to claim 2, wherein the connecting devices move in translation and [that] the inside and outside opening levers can also move in translation under the action of their respective connecting device, each lever being subject to a spring which returns it in the opposite direction to the one that corresponds to the action of the connecting device for opening the lock.

Claim 16 should read as follows:

16. Lock according to claim 13, wherein the connecting devices move in translation and [that] the inside and outside opening levers can also move in translation under the action of their respective connecting device, each lever being subject to a spring which returns it in the opposite direction to the one that corresponds to the action of the connecting device for opening the lock.

Claim 17 should read as follows:

17. Lock according to claim 5, wherein the connecting devices move in translation and [that] the inside and outside opening levers can also move in translation under the action of their respective connecting device, each lever being subject to a spring which returns it in the opposite direction to the one that corresponds to the action of the connecting device for opening the lock.

Claim 18 should read as follows:

18. Lock according to claim 6, wherein the connecting devices move in translation and [that] the inside and outside opening levers can also move in translation under the action of their respective connecting element, each lever being subject to a spring which returns it in the opposite direction to the one that corresponds to the action of the connecting element for opening the lock.

UNITED STATES PATENT AND TRADEMARK OFFICE

CERTIFICATE OF CORRECTION

PATENT NO. : 6,142,540
DATED : November 7, 2000
INVENTOR(S) : Joel Girard et al.

It is certified that error appears in the above-identified patent and that said Letters Patent is hereby corrected as shown below:

Claim 19 should read as follows:

19. [The apparatus] Lock according to the claim 13, wherein at least one of the connecting elements adopts a second extreme position in which the respective pivoting arm driven by the connecting element rotates its respective lever into an angular position to allow the lock to open.

Signed and Sealed this

Eighteenth Day of June, 2002

*Attest:*

*Attesting Officer*

JAMES E. ROGAN
*Director of the United States Patent and Trademark Office*